US009421427B2

(12) United States Patent
Chen

(10) Patent No.: US 9,421,427 B2
(45) Date of Patent: Aug. 23, 2016

(54) DIMINISHABLE AND DISTENSIBLE BALL NET BAG STRUCTURE

(71) Applicant: Benjamin Chen, Taichung (TW)

(72) Inventor: Benjamin Chen, Taichung (TW)

( * ) Notice: Subject to any disclaimer, the term of this patent is extended or adjusted under 35 U.S.C. 154(b) by 307 days.

(21) Appl. No.: 14/272,578

(22) Filed: May 8, 2014

(65) Prior Publication Data

US 2015/0321068 A1 Nov. 12, 2015

(51) Int. Cl.

*A63B 47/00* (2006.01)
*A63B 71/00* (2006.01)
*A63B 71/02* (2006.01)

(52) U.S. Cl.

CPC ..... *A63B 47/00* (2013.01); *A63B 47/002* (2013.01); *A63B 71/0036* (2013.01); *A63B 2071/025* (2013.01); *A63B 2210/50* (2013.01)

(58) Field of Classification Search

CPC ..... A63B 2210/50; A63B 47/00; A63B 2071/025; A63B 47/002; A63B 71/0036; D06F 95/004; D06F 95/002; B65F 1/062

USPC ..... 211/14

See application file for complete search history.

(56) References Cited

U.S. PATENT DOCUMENTS 2,625,973 A * 1/1953 Weldon ..... D06F 95/004 206/459.5
3,797,847 A * 3/1974 Lindsey ..... B62B 1/12 248/98
4,267,868 A * 5/1981 Lowe ..... A45C 7/0063 383/2
5,253,775 A * 10/1993 Gould ..... D06F 95/004 220/23.83
5,507,577 A * 4/1996 Fowler ..... D06F 95/002 220/9.4
6,276,548 B1 * 8/2001 Mitchell ..... D06F 95/002 220/6
6,805,225 B2 * 10/2004 Freedman ..... D06F 95/002 190/112
2006/0032992 A1 * 2/2006 Rosheuvel ..... B65F 1/062 248/97
2009/0250460 A1 * 10/2009 Chang ..... D06F 95/004 220/9.4

FOREIGN PATENT DOCUMENTS

TW M293784 U 7/2006

* cited by examiner

*Primary Examiner* — Korie H Chan
(74) *Attorney, Agent, or Firm* — Alan D. Kamrath; Kamrath IP Lawfirm, P.A.

(57) ABSTRACT

A diminishable and distensible ball net bag structure includes a net bag bottom portion, a net bag mouth rim portion, a net bag peripheral side which adjoins the net bag bottom portion and the net bag mouth rim portion, and at least four resilient elements spaced apart and disposed at four portions or at the four portions and junctions of every two adjacent said portions of the net bag peripheral side, respectively. Hence, a ball net bag for holding balls is formed. In the case of a few balls, the resilient elements contract while keeping the balls close to a mouth of the ball net bag. In the case of plenty balls, the resilient elements not only stretch and thus distend the ball net bag but also keep the balls close to the mouth to ensure easy access thereto even when the balls are removed from the ball net bag one by one.

8 Claims, 15 Drawing Sheets

DIMINISHABLE AND DISTENSIBLE BALL NET BAG STRUCTURE

BACKGROUND OF THE INVENTION

1. Technical Field

The present invention relates to a technical field of ball net bags and, more particularly, to a diminishable and distensible ball net bag structure essentially including a ball net bag of a capacity changeable with the quantity and total weight of balls contained therein to keep the balls close to the bag mouth and thus ensure easy access to the balls.

2. Description of Related Art

Ball sports, such as baseball, tennis, table tennis, basketball, and volleyball, share a common feature. That is, each training session requires so many balls that the balls have to be held in a ball net bag. Conventional ball net bags are of a fixed shape and thus are likely to crease when folded up. Conventional ball net bags are not only difficult to store but are also disadvantaged by their fixed capacity as a result of their fixed shape. Due to their fixed capacity, high-capacity conventional ball net bags holding few balls therein are inconvenient to users, because the users' hands can hardly reach the balls inevitably found at the bottoms of the ball net bags. Whereas, low-capacity conventional ball net bags annoy users with the inherent inadequacy of capacity.

SUMMARY OF THE INVENTION

It is an objective of the present invention to provide a diminishable and distensible ball net bag structure which essentially comprises a ball net bag of a capacity changeable with the quantity of balls contained therein to therefore achieve advantages as follows: in the case of a few balls, resilient elements contract while keeping the balls close to a mouth of the ball net bag; and in the case of plenty balls, the resilient elements not only stretch and thus distend the ball net bag but also keep the balls close to the mouth to ensure easy access thereto even when the balls are taken out of the ball net bag one by one.

In order to achieve the above and other objectives, the present invention provides a diminishable and distensible ball net bag structure comprising a net bag bottom portion, a net bag peripheral side, a net bag mouth rim portion, and at least four resilient elements. The upper peripheral edge of the net bag bottom portion adjoins the lower peripheral edge of the net bag peripheral side. The upper peripheral edge of the net bag peripheral side adjoins the net bag mouth rim portion. The resilient elements are disposed at four portions or at the four portions and the junctions of every two adjacent said portions of the net bag peripheral side, respectively, and are spaced apart from each other by an appropriate distance. When a few balls are placed in the ball net bag, the balls together are light enough for the resilient elements to contract while keeping the balls close to a bag mouth of the ball net bag structure to ensure easy access to the balls. When plenty balls are placed in the ball net bag, the balls together are heavy enough for the resilient elements to not only stretch and thus increase the capacity of the ball net bag in order to contain all the balls but also keep the balls close to the bag mouth to ensure easy access to the balls even when the balls are taken out of the ball net bag one by one.

DETAILED DESCRIPTION OF THE EMBODIMENTS OF THE INVENTION

Figure 1:
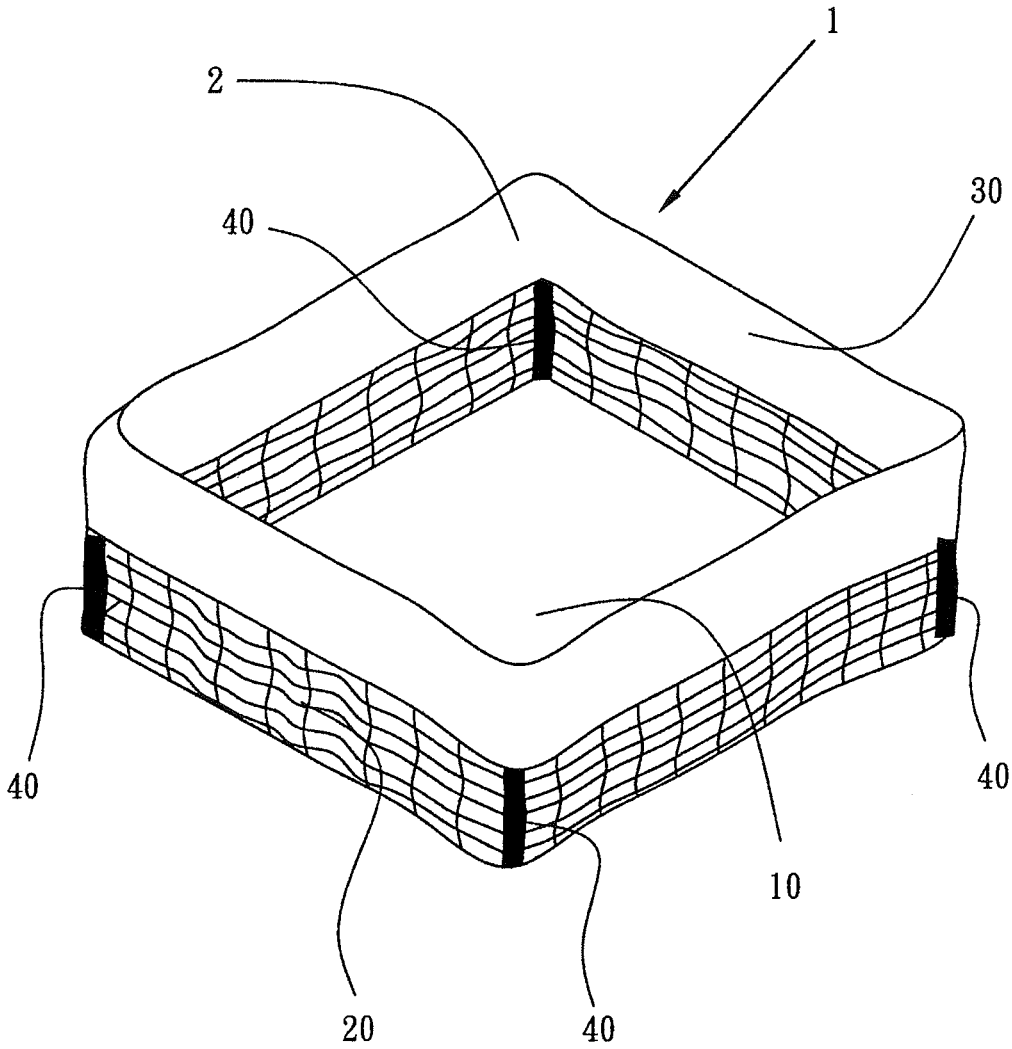
FIG. 1 is a schematic perspective view of a ball net bag structure according to an embodiment of the present invention.
Figure 2:
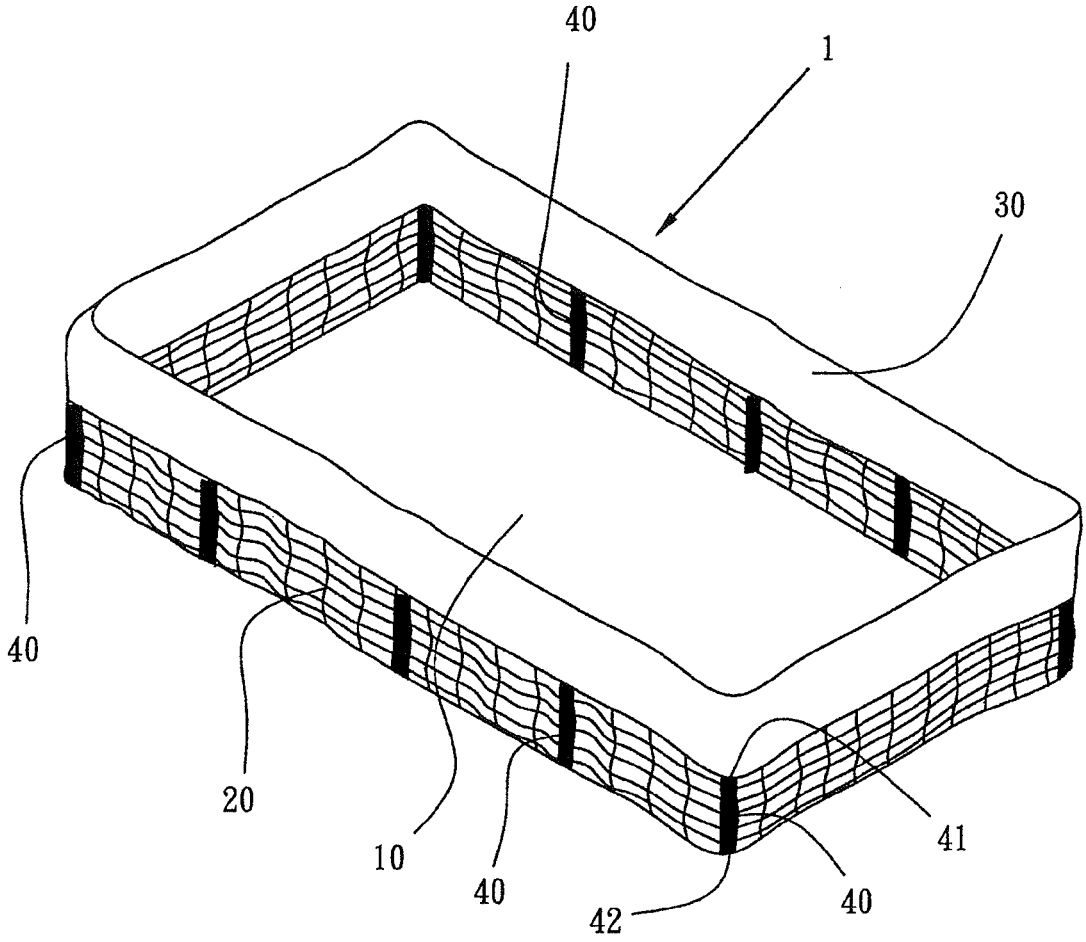
FIG. 2 is a schematic perspective view of the ball net bag structure according to another embodiment of the present invention.
Figure 3:
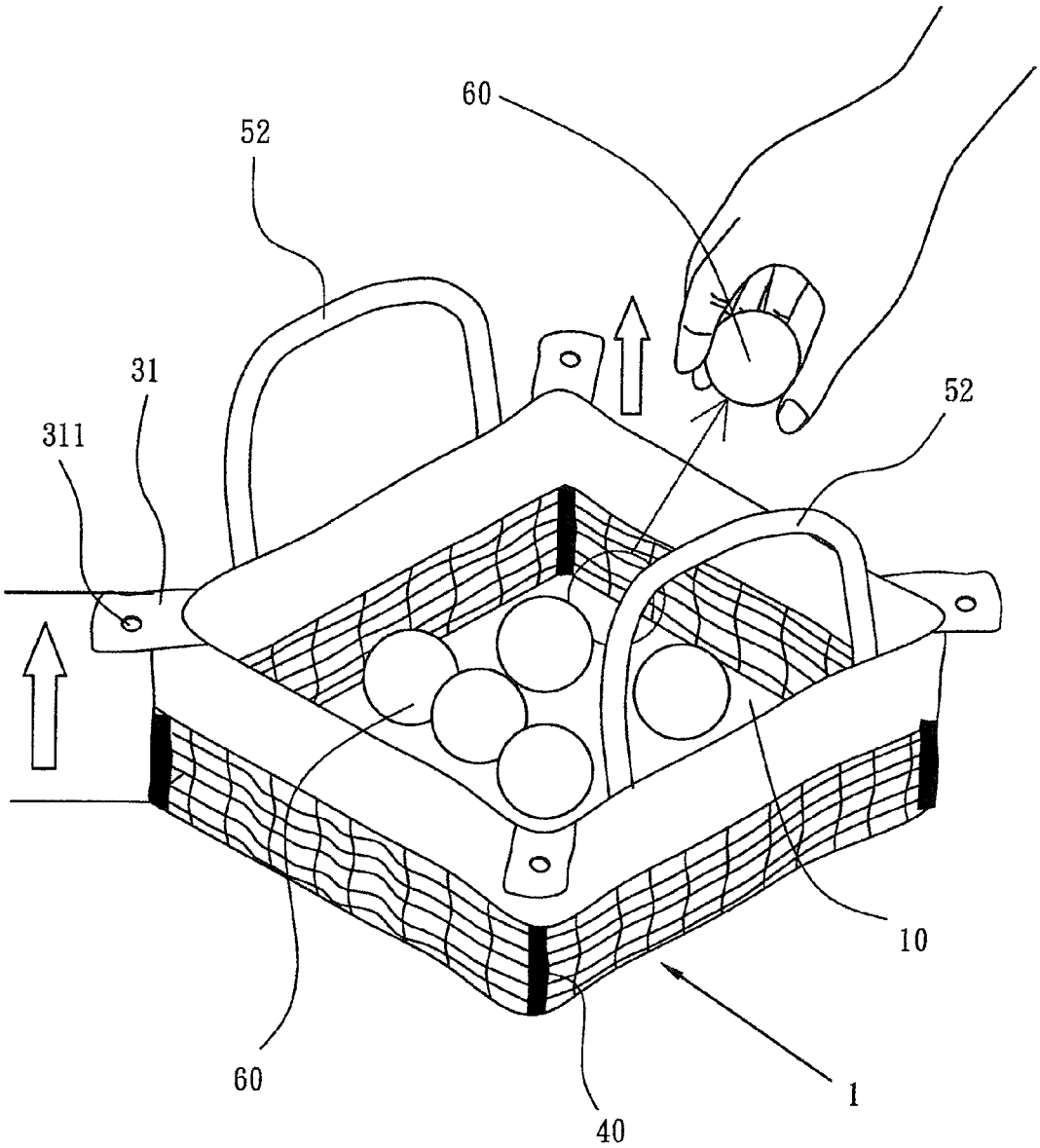
FIG. 3 is a schematic view illustrative of easy access to balls placed in the ball net bag structure of the present invention even in the event of few balls.
Figure 4:
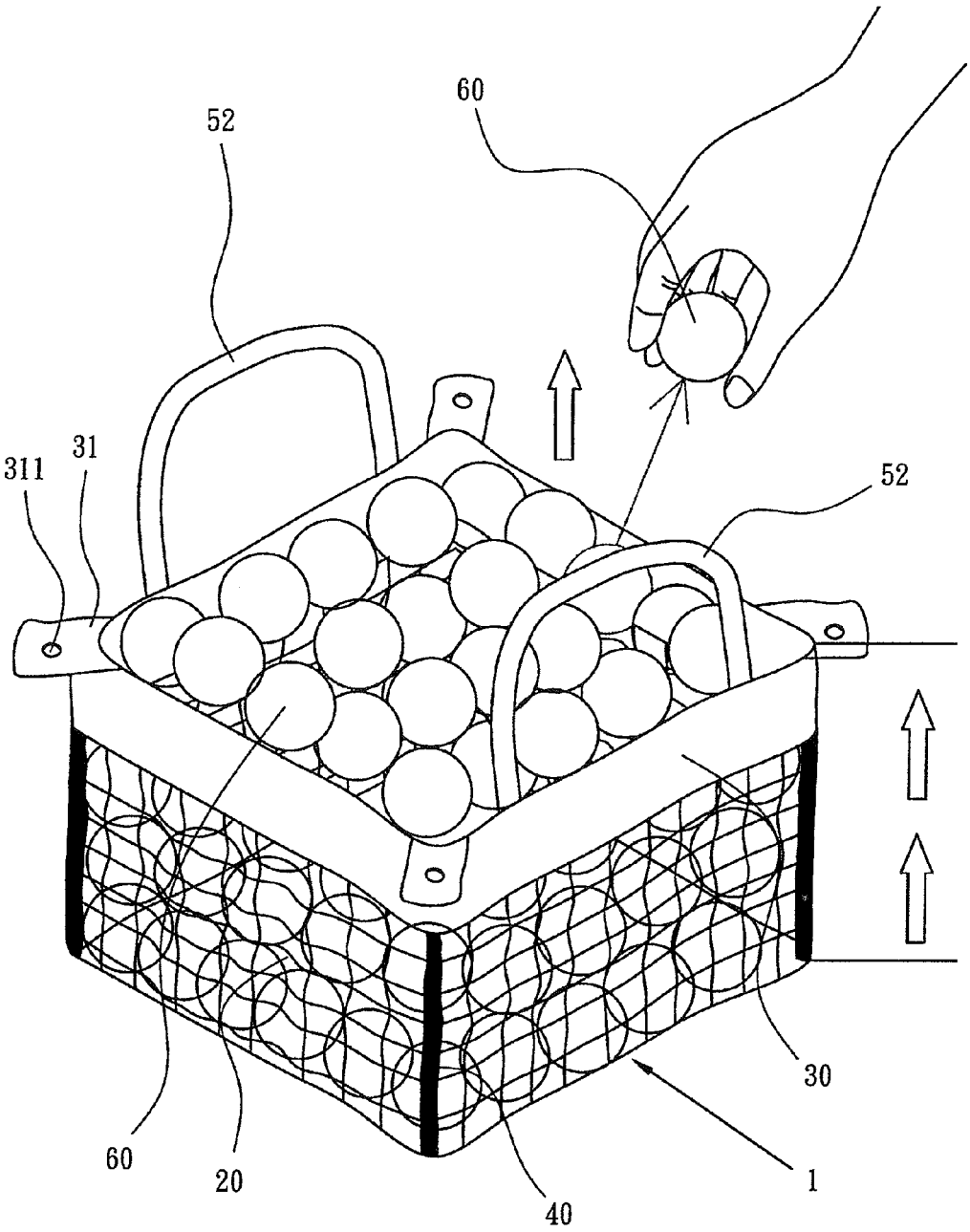
FIG. 4 is a schematic view which shows the ball net bag structure of the present invention enlarges automatically to increase the capacity thereof in the event that plenty balls are placed in the ball net bag structure.
Figure 5:
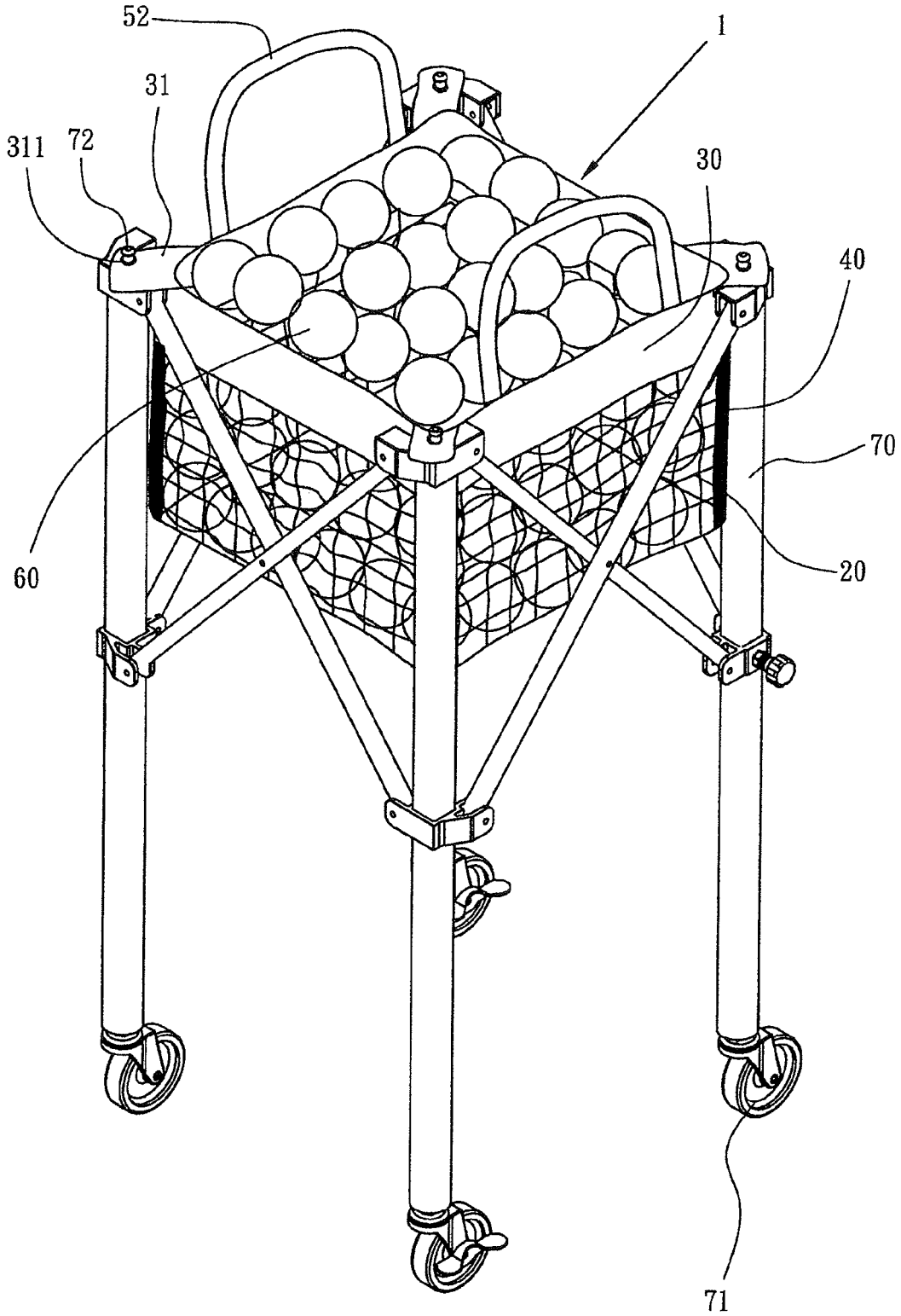
FIG. 5 is a schematic view of the ball net bag structure applicable to a ball net bag rack with rollers according to the present invention.
Figure 6:
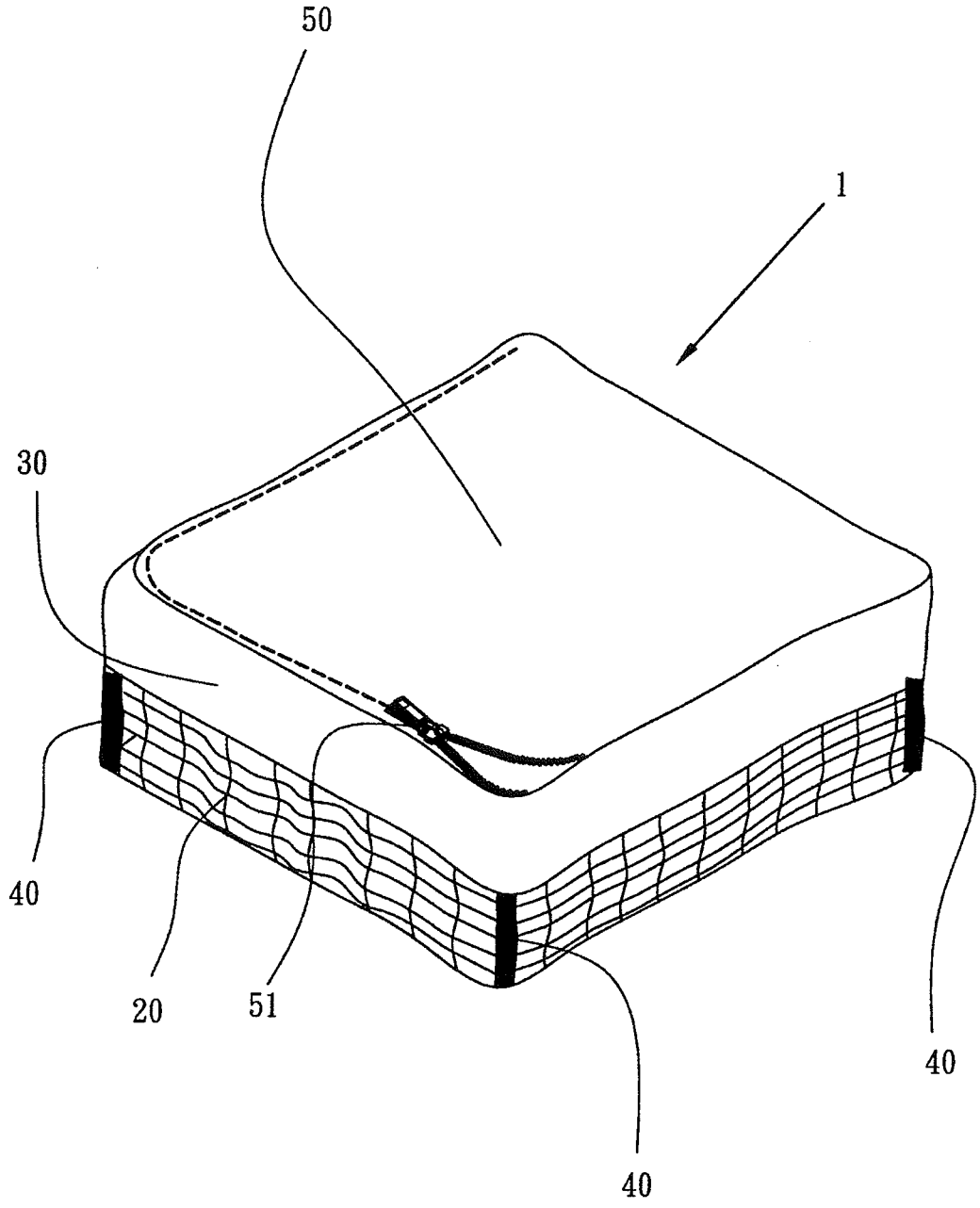
FIG. 6 is a schematic view of the ball net bag structure with a cover for covering the top surface of the ball net bag structure by a zipper according to the present invention.
Figure 7:
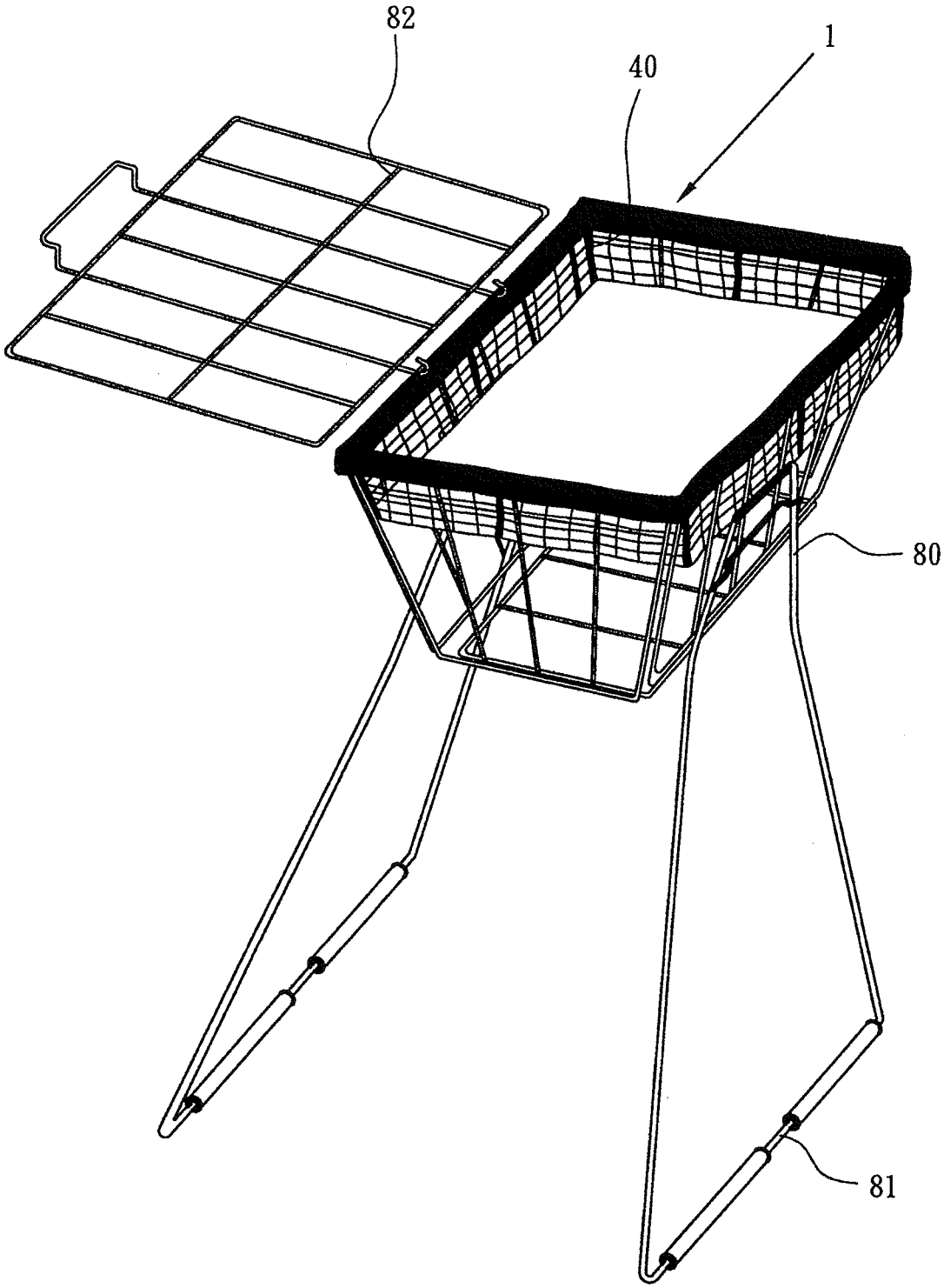
FIG. 7 is a schematic view of the ball net bag structure applicable to another ball net bag rack according to the present invention.
Figure 8:
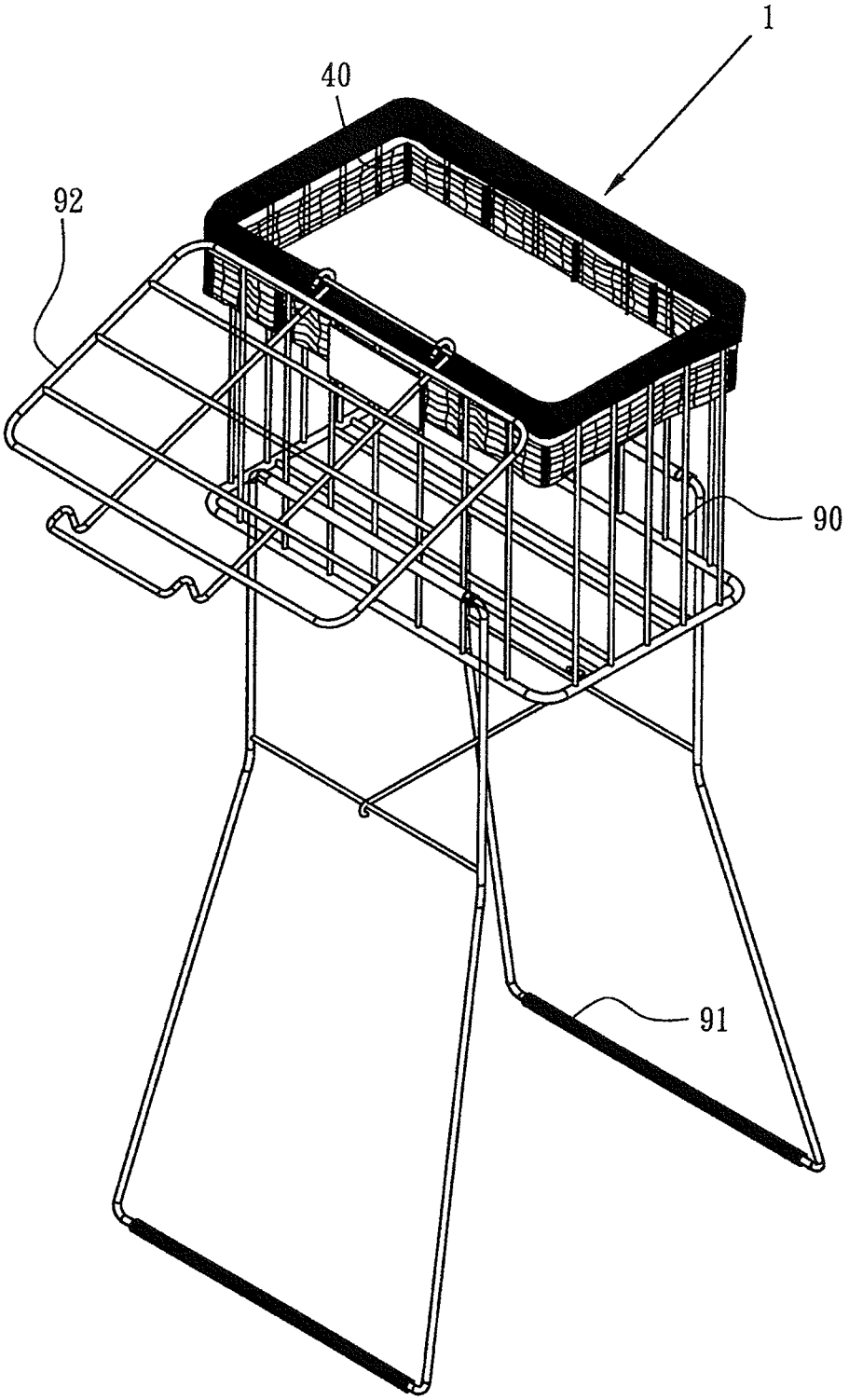
FIG. 8 is a schematic view of the ball net bag structure applicable to yet another ball net bag rack according to the present invention.
Figure 9:
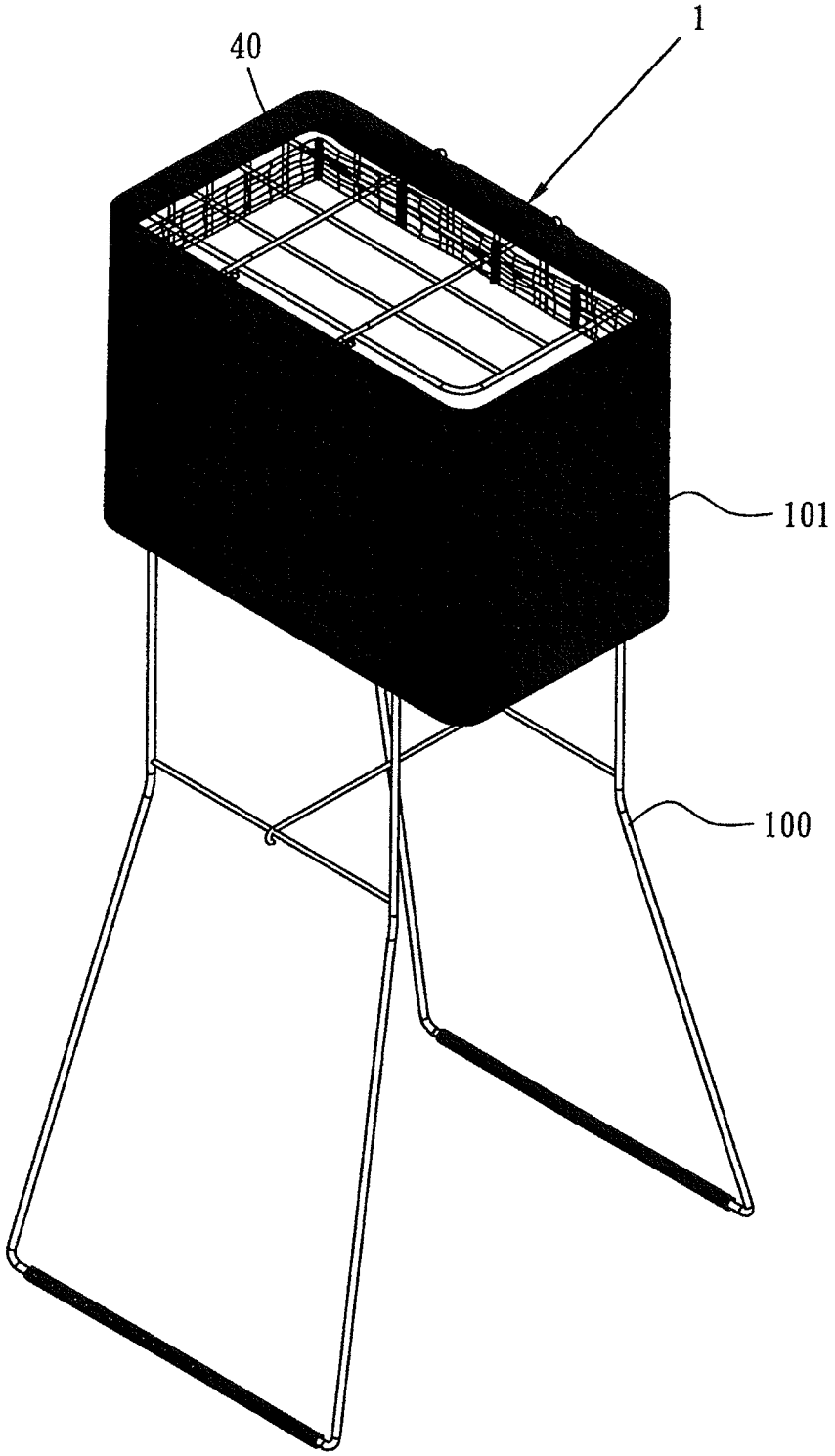
FIG. 9 is a schematic view of the ball net bag structure applicable to still yet another ball net bag rack according to the present invention.

The present invention provides a diminishable and distensible ball net bag structure.

Referring to FIG. 1 through FIG. 9, the present invention provides a diminishable and distensible ball net bag structure. The diminishable and distensible ball net bag structure comprises a net bag bottom portion 10, a net bag peripheral side 20, a net bag mouth rim portion 30, and at least four resilient elements 40.

The lower peripheral edge of the net bag peripheral side 20 adjoins the upper peripheral edge of the net bag bottom portion 10.

The net bag mouth rim portion 30 adjoins the upper peripheral edge of the net bag peripheral side 20.

The resilient elements 40 are disposed at four portions or at the four portions and the junctions of every two adjacent said portions of the net bag peripheral side 20, respectively, and are spaced apart from each other by an appropriate distance. Two ends 41, 42 of each said resilient element 40 are connected to the net bag mouth rim portion 30 and the net bag bottom portion 10, respectively, to form a ball net bag 1. When few balls 60 are placed in the ball net bag 1, the balls 60 together are light enough for the resilient elements 40 to contract while keeping the balls 60 close to a bag mouth 2 of the ball net bag structure so as to ensure easy access to the balls 60. When plenty balls 60 are placed in the ball net bag 1, the balls 60 together are heavy enough for the resilient elements 40 to not only stretch and thus increase the capacity of the ball net bag 1 in order to contain all the balls 60 but also keep the balls 60 close to the bag mouth 2 to ensure easy access to the balls 60 even when the balls 60 are taken out of the ball net bag 1 one by one.

Regarding the diminishable and distensible ball net bag structure, a cover 50 is disposed on the net bag mouth rim portion 30 and equipped with a zipper 51 for connecting the cover 50 to the net bag mouth rim portion 30.

Regarding the diminishable and distensible ball net bag structure, the net bag mouth rim portion 30 has two handles 52 above to enhance ease of transport of the ball net bag 1.

Regarding the diminishable and distensible ball net bag structure, four corners of the net bag mouth rim portion 30 extend outward to form four lugs 31, respectively. Each said lug 31 has a fixing hole 311. Multiple rollers 71 are disposed at the bottom of a first ball net bag rack 70. Mushroom-headed fixing rods 72 are disposed at the top of the first ball net bag rack 70 and fixed penetratingly to the fixing holes 311 of the lugs 31, respectively.

Regarding the diminishable and distensible ball net bag structure, the ball net bag 1 is disposed on a second ball net bag rack 80. The second ball net bag rack 80 has multiple legs 81 which rest on the ground. The second ball net bag rack 80 has an upper lid 82 for covering the ball net bag 1 from above.

Regarding the diminishable and distensible ball net bag structure, the ball net bag 1 is disposed on a third ball net bag rack 90. The third ball net bag rack 90 has multiple legs 91 which rest on the ground. The third ball net bag rack 90 has a top lid 92 for covering the ball net bag 1 from above.

Regarding the diminishable and distensible ball net bag structure, the ball net bag 1 is disposed on a fourth ball net bag rack 100. The fourth ball net bag rack 100 is peripherally provided with an enclosing fabric 101 for enclosing the fourth ball net bag rack 100.

Regarding the diminishable and distensible ball net bag structure, the resilient elements 40 each are a spring, a resilient cord, or a resilient ribbon.

Referring to FIG. 10 through FIG. 15, the present invention provides a diminishable and distensible ball net bag structure. The diminishable and distensible ball net bag structure comprises a net bag bottom portion 10, a net bag peripheral side 20, a net bag mouth rim portion 30, and at least four resilient elements 40.

The lower peripheral edge of the net bag peripheral side 20 adjoins the upper peripheral edge of the net bag bottom portion 10.

The net bag mouth rim portion 30 adjoins the upper peripheral edge of the net bag peripheral side 20.

Figure 10:
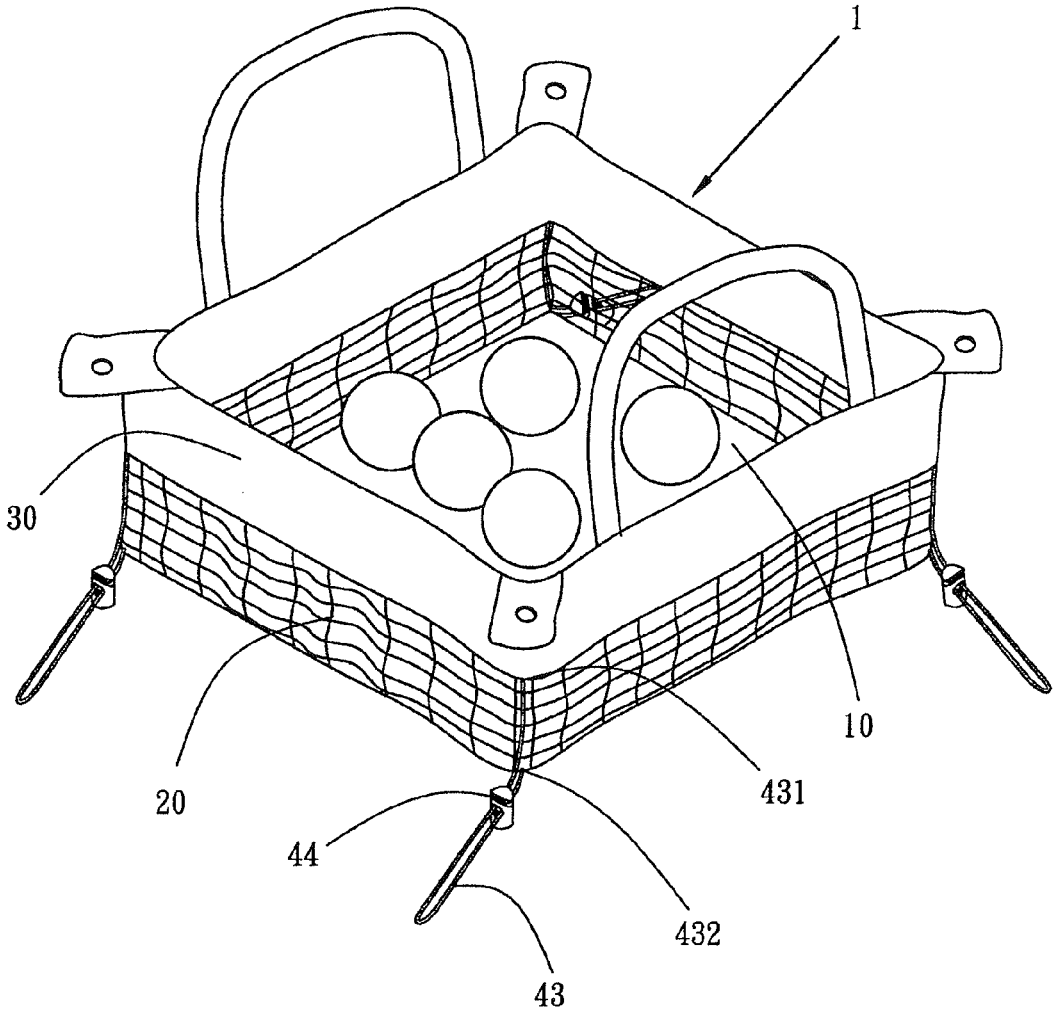
FIG. 10 is a schematic perspective view of the ball net bag structure according to another embodiment of the present invention
Figure 11:
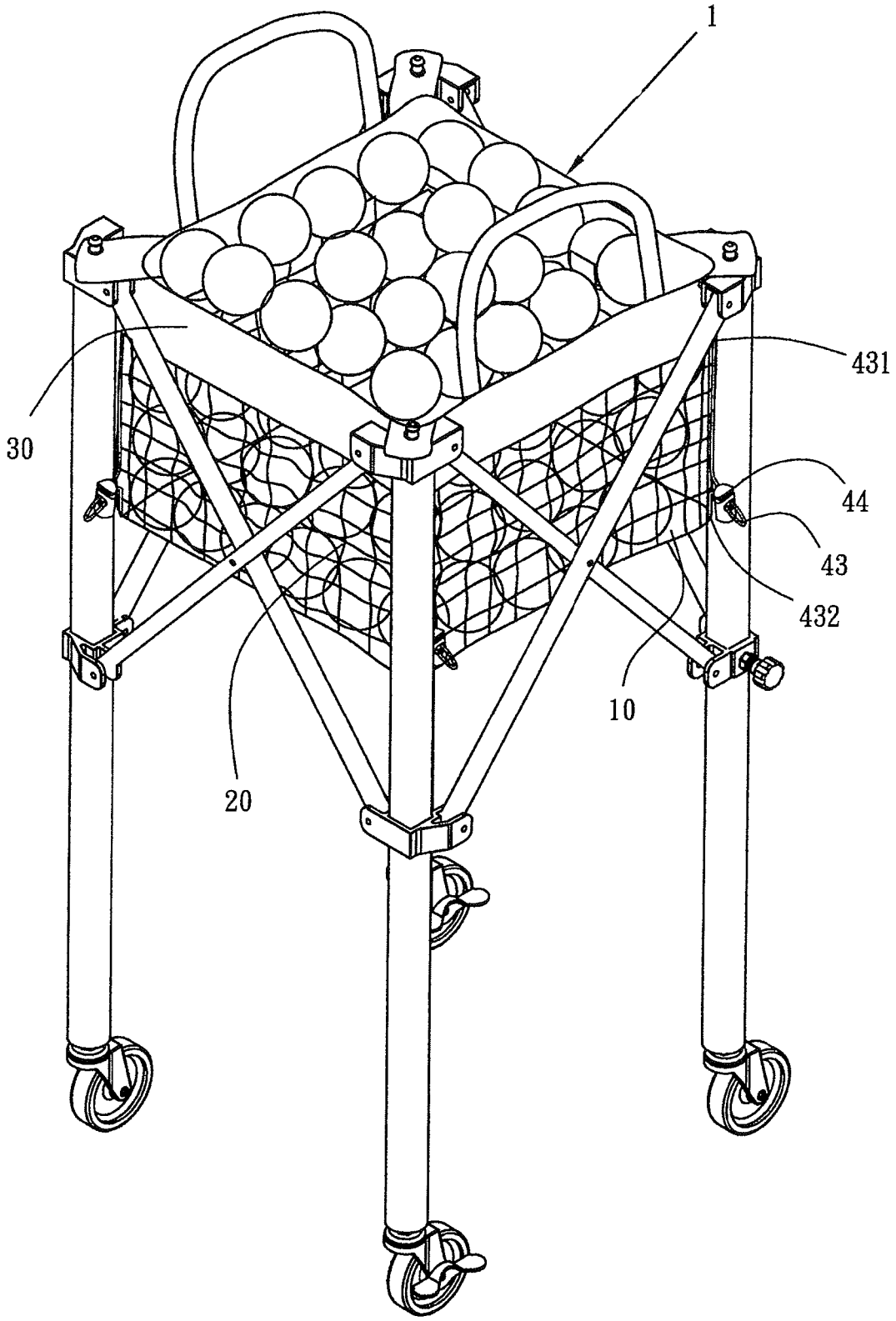
FIG. 11 is a schematic perspective view of the ball net bag structure applicable to a ball net bag rack according to another embodiment of the present invention.
Figure 12:
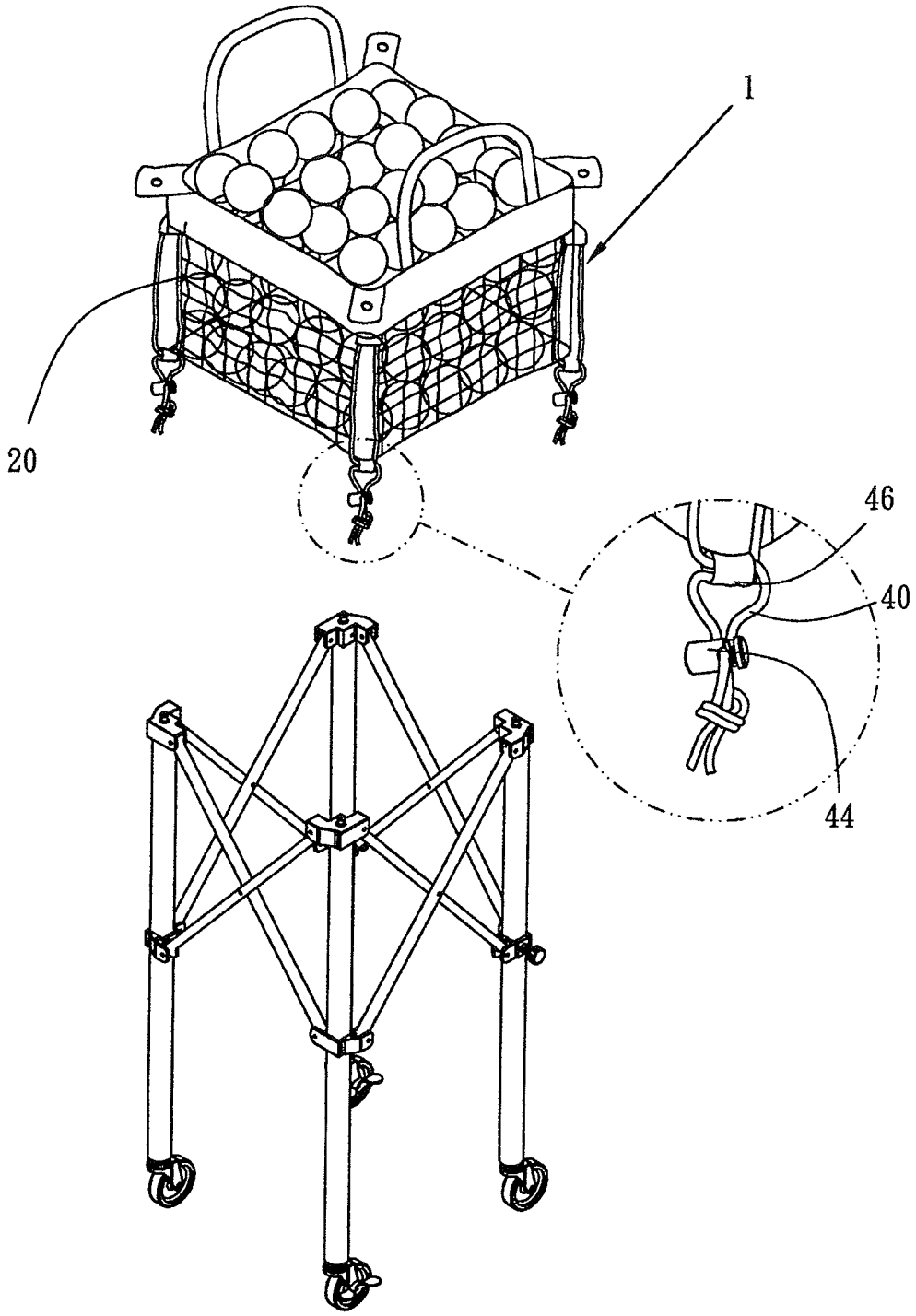
FIG. 12 is a schematic exploded view of the ball net bag structure applicable to the ball net bag rack according to yet another embodiment of the present invention.
Figure 13:
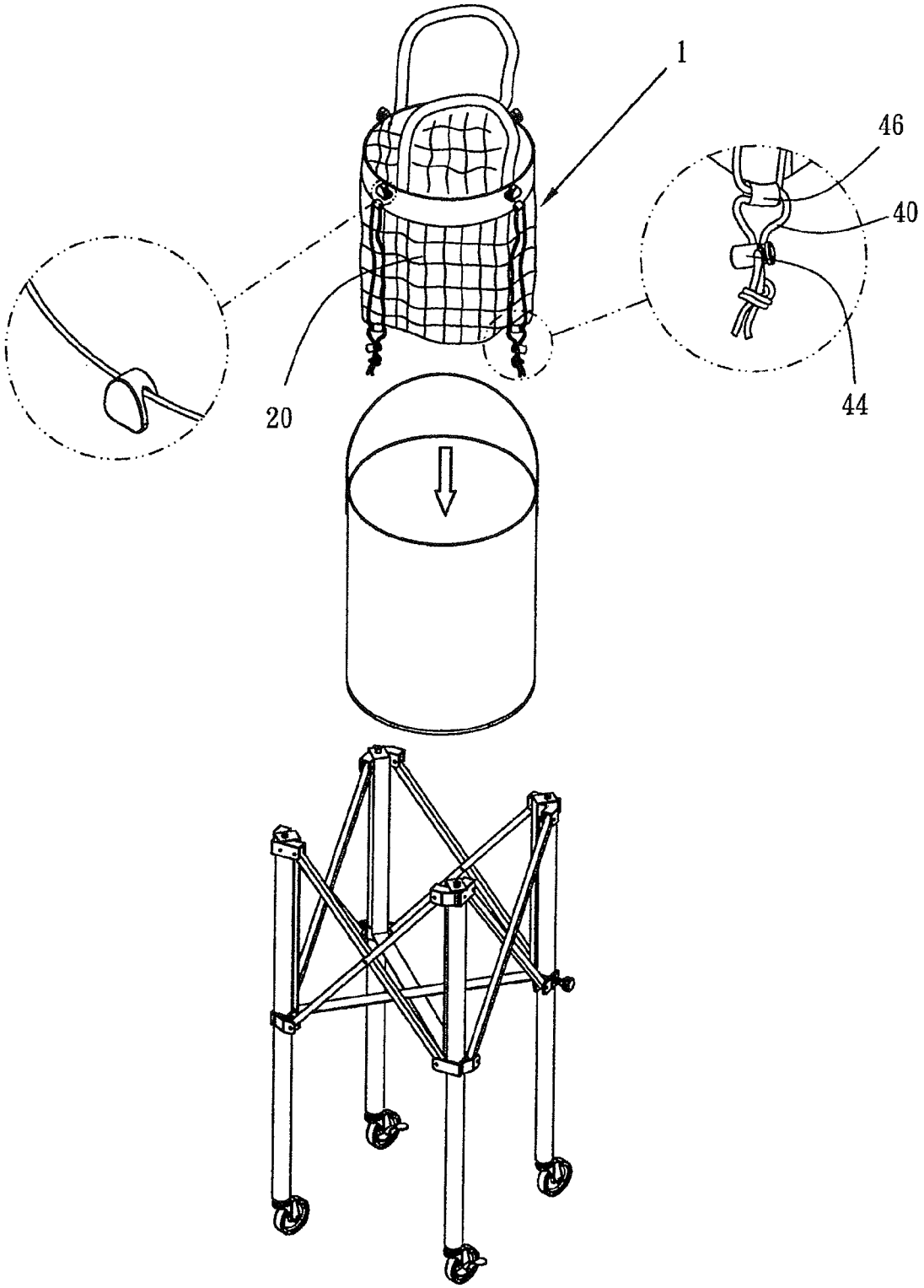
FIG. 13 is a schematic exploded view of the ball net bag structure applicable to the ball net bag rack according to still yet another embodiment of the present invention.
Figure 14:
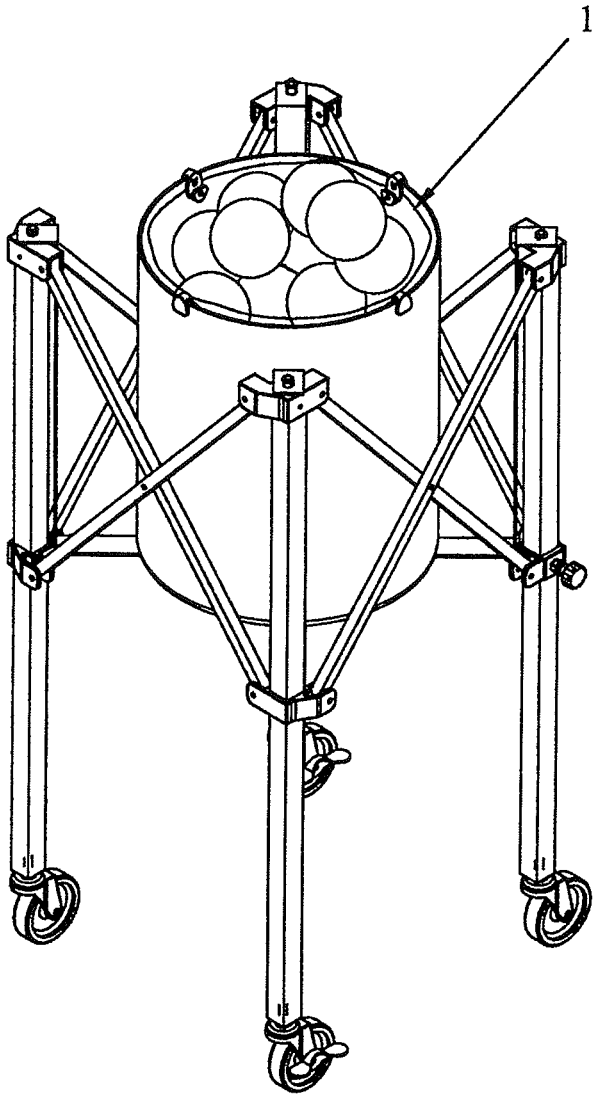
FIG. 14 is a schematic perspective view of the ball net bag structure applicable to the ball net bag rack according to a further embodiment of the present invention.
Figure 15:
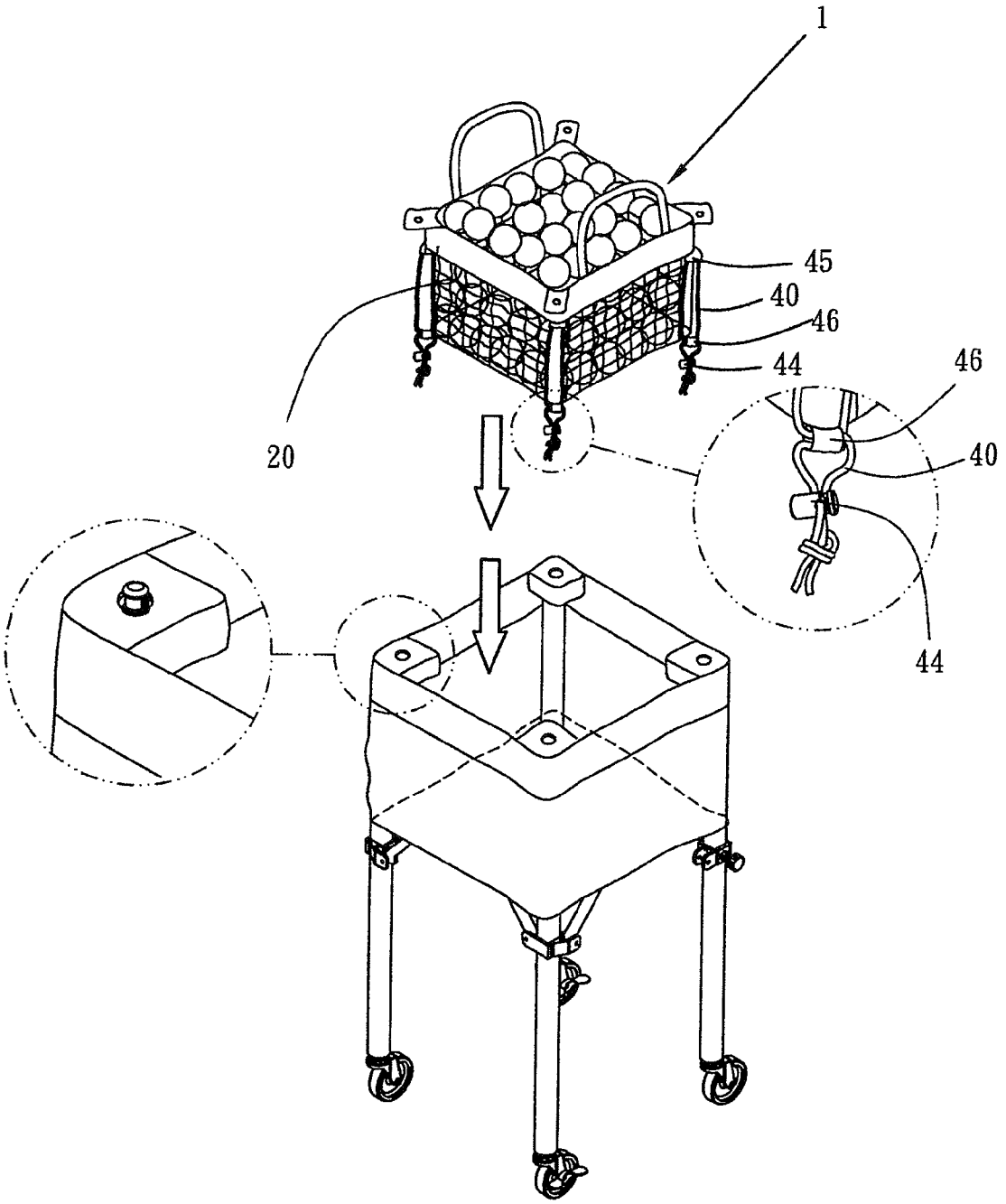
FIG. 15 is a schematic exploded view of the ball net bag structure applicable to the ball net bag rack according to a further embodiment of the present invention.

The resilient elements 40 are disposed at four portions or at the four portions and the junctions of every two adjacent said portions of the net bag peripheral side 20, respectively, and are spaced apart from each other by an appropriate distance. The resilient elements 40 each comprise a resilient cord 43 fastened to a resilient fastener 44. Two ends 431, 432 of each said resilient cord 43 are connected to the net bag mouth rim portion 30 and the net bag bottom portion 10, respectively, to form a ball net bag 1. The length of the resilient cord 43 can be adjusted by compressing the resilient fastener 44, to decrease the capacity of the ball net bag 1 (as shown in FIG. 10) and to increase the capacity of the ball net bag 1 (as shown in FIG. 11). In another embodiment of the present invention, an upper ring 45 and a lower ring 46 are fixed to the upper end and the lower end, respectively, of each of the segments defined at four portions or at the four portions and the junctions of every two adjacent said portions of the net bag peripheral side 20, respectively, and are spaced apart from each other by an appropriate distance. The resilient cord 43 passes through the upper ring 45. Afterward, two ends of the resilient cord 43 cross at the lower ring 46, and the two ends of the resilient cord 43 are fastened to the resilient fastener 44. The length of the resilient cord 43 can be adjusted by compressing the resilient fastener 44, to finalize the construction of the ball net bag 1.

In conclusion, the diminishable and distensible ball net bag structure according to the present invention is not only novel and thus meets the novelty requirement of invention patentability, but is also comprehensively innovative and thus meets the non-obviousness requirement of invention patentability. Furthermore, not only does the capacity of the ball net bag change with the quantity and total weight of the balls contained therein, but the ball net bag also keeps the balls close to the bag mouth to ensure easy access to the balls, thereby having high industrial applicability.

What is claimed is:

1. A diminishable and distensible ball net bag structure, comprising:

a net bag bottom portion;

a net bag peripheral side having at least four portions and a lower peripheral edge adjoining an upper peripheral edge of the net bag bottom portion;

a net bag mouth rim portion adjoining an upper peripheral edge of the net bag peripheral side; and at least four resilient elements disposed at the at least four portions or at the at least four portions and junctions of every two adjacent said four portions of the net bag peripheral side, respectively, and spaced apart from each other by an appropriate distance, wherein ends of each said resilient element are fixed to an upper ring and a lower ring, respectively, and a resilient cord passes through the upper ring, such that two ends of the resilient cord cross at the lower ring and then get fastened to a resilient fastener, wherein a length of the resilient cord is adjusted by compressing the resilient fastener, thereby finalizing construction of a ball net bag.

2. The diminishable and distensible ball net bag structure of claim 1, wherein a cover is disposed on the net bag mouth rim portion and is equipped with a zipper for connecting the cover to the net bag mouth rim portion.

3. The diminishable and distensible ball net bag structure of claim 1, wherein two handles are disposed on the net bag mouth rim portion and adapted to enhance ease of transport of the ball net bag.

4. The diminishable and distensible ball net bag structure of claim 1, wherein four corners of the net bag mouth rim portion extend outward to form four lugs, respectively, and wherein the four lugs each have a fixing hole penetrated by and engaged with a corresponding one of mushroom-headed fixing rods disposed at a top of a first ball net bag rack with a bottom equipped with multiple rollers.

5. The diminishable and distensible ball net bag structure of claim 1, wherein the ball net bag is disposed on a ball net bag rack with multiple legs which rest on a ground, and wherein the ball net bag rack has an upper lid for covering the ball net bag.

6. The diminishable and distensible ball net bag structure of claim 1, wherein the ball net bag is disposed on a ball net bag rack with multiple legs which rest on a ground, and wherein the ball net bag rack has a top lid for covering the ball net bag.

7. The diminishable and distensible ball net bag structure of claim 1, wherein the ball net bag is disposed on a ball net bag rack, and wherein the ball net bag rack is peripherally provided with an enclosing fabric for enclosing the ball net bag rack.

8. The diminishable and distensible ball net bag structure of claim 1, wherein the at least four resilient elements each are one of a spring, a resilient cord, and a resilient ribbon.

* * * * *